US005082985A

United States Patent [19]

Crouzet et al.

[11] Patent Number: 5,082,985

[45] Date of Patent: Jan. 21, 1992

[54] PROCESS FOR CONTROLLING HYDROCARBON STEAM CRACKING SYSTEM USING A SPECTROPHOTOMETER

[76] Inventors: Pierre G. Crouzet, 5, Allée Darius Milhaud, 13500 Martigues, France; André J. Martens, Les Jardinets - Avenue Jules Ferry, 13220 Chateauneuf Les Martigues, France

[21] Appl. No.: 354,219

[22] Filed: May 19, 1989

[30] Foreign Application Priority Data

May 30, 1988 [FR] France ..... 8807322

[51] Int. Cl.[5] ..... C10G 9/36

[52] U.S. Cl. ..... 585/501; 585/613; 208/130; 208/DIG. 1

[58] Field of Search ..... 208/106, 130, DIG. 1; 585/501, 613

[56] References Cited

U.S. PATENT DOCUMENTS

| | | | |
|---|---|---|---|
| 3,384,573 | 5/1968 | Gorring | 208/DIG. 1 |
| 3,824,388 | 7/1974 | Cugini | 208/DIG. 1 |
| 3,972,804 | 8/1976 | McLaughlin et al. | 208/DIG. 1 |
| 4,257,105 | 3/1981 | Stewart et al. | 208/DIG. 1 |
| 4,318,178 | 3/1982 | Stewart et al. | 208/130 |
| 4,371,944 | 2/1983 | Stewart et al. | 208/130 |
| 4,628,204 | 12/1986 | Maes | 210/745 |
| 4,908,121 | 3/1990 | Hackmesser et al. | 208/130 |
| 4,929,335 | 5/1990 | Altman et al. | 208/DIG. 1 |

FOREIGN PATENT DOCUMENTS

| | | | |
|---|---|---|---|
| 0285251 | 10/1988 | European Pat. Off. . | |
| 0304232 | 2/1989 | European Pat. Off. . | |
| 0305090 | 3/1989 | European Pat. Off. . | |
| 0328826 | 8/1989 | European Pat. Off. . | |
| 0368560 | 5/1990 | European Pat. Off. . | |
| 0590329 | 1/1978 | U.S.S.R. | 585/501 |
| 873863 | 7/1961 | United Kingdom | 585/501 |

OTHER PUBLICATIONS

Frank, I. E. *J. Chem. Inf. Comput. Sci.*, 1984, vol. 24, pp. 20–24.

Analytical Chemistry, vol. 59, No. 9, May 1, 1987, pp. 624A–637A.

American Chemical Society, J. B. Callis et al., "Process . . . Chemistry".

Applied Spectroscopy Reviews, vol. 21, No. 1 & 2, 1985, pp. 1–43, Marcel Dekker, Inc., N.Y. US, L. G. Weyer, "Near-Infrared . . . Substances".

Lyon, R. E., "Pilot Plant Application of Analytical Instruments", *American Petroleum Institute's Proceedings*, vol. 42, No. 3 (1962), pp. 602–609.

Karasek, F., "Analytical Instruments in Process Control", *Scientific American*, vol. 220, #6, Jun. 1969, pp. 112–119.

*Primary Examiner*—Patrick P. Garvin
*Assistant Examiner*—G. Fourson
*Attorney, Agent, or Firm*—Ladas & Parry

[57] ABSTRACT

The present invention relates to a process and an apparatus for steam cracking a mixture of hydrocarbons comprising passing steam and the mixture of hydrocarbons through at least one heated cracking tube. The process is characterised in that it is controlled by analyzing the mixture of hydrocarbons fed to the cracking tube with an infrared spectrophotometer to determine the absorbances at a number n of wavelengths in the range 0.8 to 2.6 microns and by using the results of this absorbance to determine one or more values V of steam cracking process conditions which will achieve a desired value P of the space time yield of one or more products of the steam cracking reaction.

16 Claims, No Drawings

PROCESS FOR CONTROLLING HYDROCARBON STEAM CRACKING SYSTEM USING A SPECTROPHOTOMETER

The present invention relates to a process and an apparatus for cracking hydrocarbons in the presence of steam, intended for the manufacture of olefins and diolefins, particularly ethylene and propylene. It consists particularly in using an infrared spectrophotometer making it possible to analyse the hydrocarbons feeding a cracking furnace, and in controlling, in particular, the yields of olefins and diolefins as a function of this analysis.

It is known to perform hydrocarbon cracking or pyrolysis in the presence of steam, also known as steam-cracking, by passing a mixture of hydrocarbons and steam through a cracking tube arranged in a furnace heated to a high temperature. The hydrocarbons are subjected to a cracking reaction which converts them particularly (i) into a gaseous hydrocarbon fraction comprising particularly olefins containing from 2 to 6 carbon atoms, such as ethylene, propylene and isobutene, and diolefins, such as butadiene and isoprene, (ii) into a liquid hydrocarbon fraction, also called "steam-cracking gasoline", comprising particularly hydrocarbons containing from 5 to 12 carbon atoms, (iii) and into undesirable byproducts, such as methane.

In general, for each type of hydrocarbons to be cracked, the conditions of the cracking reaction are chosen such as to make it possible to manufacture at least one product or a group of products, such as an olefin, a diolefin or a steam-cracking gasoline, in a desired yield. A yield of a cracking reaction product means the weight ratio of the manufactured quantity of this product to the quantity of hydrocarbons employed. However, it is commonly observed that a cracking furnace is fed with a mixture of hydrocarbons whose nature and composition can frequently vary with time, according to the source of these hydrocarbons. It therefore appears necessary to modify the conditions of the cracking reaction as often as the nature and the composition of the hydrocarbon mixture change, if it is intended to manufacture at least one product or a group of products according to a desired yield. From this it follows that, during the cracking reaction, generally it is important to determine as frequently as possible the characteristics of the mixtures of hydrocarbons to be cracked. However, these characteristics are generally determined by separate and specific measurements, each of which requires the use of a specific apparatus and analytical method, and which require a relatively long time. Thus, when the nature and the composition of the hydrocarbon mixture vary with time, the conditions of the cracking reaction are consequently modified with a relatively long delay, and it is no longer possible to maintain the desired yields at preset values. The importance of such disadvantages is easily understood when, moreover, the generally considerably size of an industrial hydrocarbon cracking plant is known.

A process and an apparatus for steam-cracking hydrocarbons have now been found, which make it possible to avoid the above mentioned disadvantages and to manufacture olefins and diolefins in yields which can be preset at desired values. One of the aims of the present invention is to control the space time yield of one or more products of a hydrocarbon steam-cracking reaction directly with the help of near infrared absorbance measurements of a mixture of hydrocarbons feeding a cracking tube. One of the main advantages of the present process is the ability to control a steam-cracking reaction without knowing the physical and/or chemical characteristics of the hydrocarbon mixture to be cracked. More precisely, all the numerical data obtained by the measurements of absorbance of the hydrocarbon mixture at wavelengths chosen in the near infrared region can be directly used as information for the control of the steam-cracking reaction, in order to get the desired space time yield P of one or more reaction products. In particular, the present invention makes use of an infrared spectrophotometer which, during the cracking reaction, makes it possible to perform, in an extremely short time, a series of measurements whose results directly make it possible to determine the reaction conditions necessary for the manufacture of olefins, of diolefins and of other reaction products in desired yields.

The subject of the present invention is, therefore, first of all a process for steam cracking a mixture of hydrocarbons comprising passing steam and the mixture of hydrocarbons through at least one heated cracking tube, characterised in that the process is controlled by (a) analysing the mixture of hydrocarbons fed to the cracking tube with an infrared spectrophotomer to determine the absorbances at a number n of wavelengths in the range 0.8 to 2.6 microns, (b) using the absorbance results to determine at least one value V of the conditions of the steam-cracking reaction and (c) controlling the process to operate at the determined value(s) V in order to obtain a desired value P of the space time yield of at least one product.

One of the essential features of the present invention is carrying out during the cracking reaction absorbance measurements on the mixture of hydrocarbons feeding the cracking tube with the aid of an infrared spectrophotometer operating according to the reflection method, or the transmission method, or else a combination of both these methods. According to the Beer-Lambert law, the absorbance is generally defined as being the decimal logarithm of the relationship between the intensity Io of the radiation emitted by the infrared spectrophotometer and the intensity I of the radiation transmitted and/or reflected by the mixture of hydrocarbons.

More particularly, what is involved is performing, a number of times during the cracking reaction, a series of n measurements of the absorbance of the mixture of hydrocarbons at n wavelengths chosen in the near infrared region, ranging from 0.8 to 2.6 microns, preferably from 1.0 to 2.5 microns, and more particularly from 1.4 to 2.5 microns. The number n of the absorbance measurements is generally from 2 to approximately 20, preferably from 2 to 10. The choice of the number n of the absorbance measurements is partly related to the accuracy with which it is subsequently desired to determine the value V of at least one of the conditions of the cracking reaction. It is possible, for example, to choose to perform the absorbance measurements at wavelengths chosen from the following, expressed in microns, or at substantially closely related wavelengths:

2.141, 2.166, 2.181, 2.278, 2.308, 2.347, 2.375, 2.398, 2.439, 2.457 and 2.475.

More particularly, the absorbance measurements may be carried out at the following 5 wavelengths, expressed in microns, or at substantially closely related wavelengths: 2.278, 2.308, 2.398, 2.439 and 2.475.

The wavelengths to be employed in the process for obtaining a desired space time yield P of one or more products of a steam-cracking reaction can be selected by statistical methods with the help of factor anslyses and multilinear regressions, during a calibration procedure. More precisely, this procedure may consist in steam cracking a number of the hydrocarbon mixtures under various conditions according to an orthogonal set of experiments, carried out in a cracking tube of an industrial plant or as cracking tube of a laboratory, such as of a micro-pyrolysis apparatus, and in selecting the wavelengths in the near infrared region, so that a correlation relationship connecting the space time yield P with the n results Ri of the n absorbance measurements and with the values V of the process conditions is established with an optimum accuracy to control the process as desired. The wavelengths generally selected are those the absorbance of which changes most during the calibration procedure.

Another essential characteristic of the present invention is to set in an extremely short time, as a function of the absorbance measurements, at least one of the conditions of the cracking reaction so that the space time yield of one or more reaction products is equal to a desired value P. The conditions of the cracking reaction are those usually known in the case of a reaction of this type and may be chosen particularly from the flow rates of steam and of the hydrocarbon mixture feeding the cracking tube, the cracking temperature at any point of this tube, especially at the entry or at the exit of the furnace radiation zone, the cracking pressure at any point in this tube, especially at the exit of the furnace radiation zone, and the weight ratio of the quantity of the hydrocarbon mixture employed to that of steam.

Furthermore, one of the aims of the present invention is to control the process to achieve a desired space time yield P of one or more products originating from the cracking reaction. In particular, it is possible to control the process to achieve a desired space time yield of an olefin such as ethylene, propylene or 1-butene, the space time yield of a diolefin such as butadiene, or else the space time yield of a number of reaction products such as "steam-cracking gasoline". The space time yield of one or more products of the reaction may be defined by the production rate corresponding to the quantity of the product(s) manufactured per unit time. The space time yield may also be defined as being the yield of the cracking reaction in terms of one or more products. It may also be defined by a ratio between two quantities of manufactured products such as, for example, the ratio between the manufactured quantities of ethylene and of propylene, or the ratio between the manufactured quantities of hydrocarbons containing 3 carbon atoms and hydrocarbons containing 4 carbon atoms. In this case, this ratio is an indication of the selectivity of the cracking reaction between two products or two groups of products.

The process of the present invention consists, in particular, in determining the value V of at least one of the conditions of the cracking reaction as a function of the n results $R_i$ originating from each series of n absorbance measurements, as well as at least one desired value P of a space time yield. Thus, each time a series of n absorbance measurements are performed, at least one of the conditions of the cracking reaction is determined at a value V which makes it possible to obtain the desired space time yield. In practice, a number of series of n absorbance measurements are performed and, as a result, the value V is determined a number of times during the cracking reaction, preferably at regular intervals of time, for example once per day or per hour, or once every 5 or 15 minutes.

Furthermore, the value V of one of the conditions of the cracking reaction may be advantageously determined by means of a correlation relationship relating the reaction conditions to a number of variables. These variables consist, in particular, of the n results $R_i$ of the n absorbance measurements, of at least one desired value P of the space time yield and, if desired, of one or more other reaction conditions. The correlation relationship may be established beforehand by means of a multivariant regression performed by starting with the values of space time yield of products obtained in different cracking conditions for various hydrocarbon mixtures. In particular, it may be a linear function of the n results $R_i$ of the n absorbance measurements, of a value P at least one desired space time yield and of a value V of at least one condition of the reaction.

The correlation relationship may be, for instance, of the general form:

$$P = a + \sum_i b_i \cdot R_i + \sum_m c_m \cdot V_m$$

in which P represents a value of the space time yield of one reaction product, $R_i$ represents one of the values of the n measurements of absorbance with i varying from 1 to n, $V_m$ represents one of the values of the conditions of the steam-cracking reaction, m represents the number of the steam cracking reaction conditions controlled and a, $b_i$ and $c_m$ represent numerical coefficients, being negative or positive, integer or decimal.

The correlation relationship also may be an algebraic function of these same variables and may contain products or quotients of these variables, for instance, accordingly to one of the following general forms:

$$P = a + \sum_{ij} (b_i + k_{ij} \cdot R_j) R_i + \sum_m c_m \cdot V_m$$

or $$P = a + \sum_{ij} (b_i + k_{ij}/R_j) R_i + \sum_m c_m \cdot V_m$$

or $$P/V_1 = a + \sum_{ij} (b_i + k_{ij} \cdot R_j) R_i + \sum_m c_m \cdot V_m$$

or $$P/V_1 = a + \sum_{ij} (b_i + k_{ij}/R_j) R_i + \sum_m c_m \cdot V_m$$

or $$P/P^1 = a + \sum_{ij} (b_i + k_{ij} \cdot R_j) R_i + \sum_m c_m \cdot V_m$$

or $$P/P^1 = a + \sum_{ij} (b_i + k_{ij}/R_j) R_i + \sum_m c_m \cdot V_m$$

in which the variables and parameters are defined as previously, $V_l$ represents one of the values $V_m$ of the conditions of the steam-cracking reaction, kij represents a numerical coefficient, being negative or positive, integer or decimal, $R_j$ represents one of the values of the n measurements of absorbance with $j$ being different from $i$ and varying from 1 to n and P and $P^1$ represent values of the space time yield of two reaction products. This correlation relationship is affected by the type of infrared spectrophotometer employed, by the conditions in which it is employed, by the chosen n wavelengths, and by the product(s) of the cracking reaction, whose space time yield it is desired to control.

When the process consists, in particular, in controlling two or more conditions of the cracking reaction, it is advisable to determine an appropriate value V for each of these conditions, in particular with the aid of correlation relationships such as previously defined.

The determination of the value V may be advantageously carried out by means of a calculator. The function of the latter is to calculate the value V from the variables on which it depends, in particular from the n results $R_i$ of the n absorbance measurements and from at least one desired value P. When the calculator is connected directly to the infrared spectrophotometer, the acquisition of the n results $R_i$ by the calculator is virtually instantaneous, and the complete determination of the value V can take a few minutes, generally less than 2 minutes.

When the value V relating to a condition of the cracking reaction has thus been determined, the process is controlled to operate at this value by means which are known per se, in particular by means of a process computer, preferably connected to means of control capable of maintaining the condition at the determined value V, until the time when a new series of n absorbance measurements is carried out. If the nature and/or the composition of the mixture of hydrocarbons to be cracked have changed during the interval between two successive series of n absorbance measurements, a new value V will then be determined from the latest series of measurements carried out and the condition of the cracking reaction will be immediately corrected and controlled at this new value, in order to maintain the space time yield in respect of one or more reaction products at the desired value P.

One of the main advantages of the process of the present invention is the ability to maintain the space time yield in respect of one or more products of the cracking reaction at a constant value, whatever the fluctuations in the nature or in the composition of the mixture of hydrocarbons feeding the cracking tube. In particular, it is quite remarkable to find that, by virtue of this process, the corrections to the conditions of the cracking reaction are made in an extremely short time, which makes it possible to control the process to minimise the manufacture of undesirable products or to control the process to achieve satisfactory space time yields. This result is obtained particularly by the fact that the present process does not comprise a step for determining the physical and/or chemical characteristics of the hydrocarbon mixture to be cracked. The results of the absorbance measurements can be directly used in the form of numerical data in the correlation relationships connecting these results with the desired space time yield P and with the values V of the conditions of the steam-cracking reaction. It is especially surprising to find that a steam cracking process is able to tolerate great variations in the feedstock, such as from liquid hydrocarbons containing approximately from 5 to 15 carbon atoms, such as naphtha, light gasolines and gas oil, to gaseous hydrocarbons such as alkanes containing from 2 to 4 carbon atoms, mixed, if appropriate, with alkenes containing from 2 to 6 carbon atoms or with methane and alkanes containing from 5 to 6 carbon atoms, in particular natural gas, liquefied petroleum gas, also known as LPG, ethane, propane, butane or secondary light products originating from the steam cracking of liquid hydrocarbons.

The conditions of the cracking reaction can be corrected instantaneously as a function of the nature and composition of the mixture of hydrocarbons to be cracked, and can be controlled at values V included within known limits. In particular, the temperature of the reaction mixture at the entry of the radiation zone of the furnace is from approximately 400° C. to 700° C., the temperature of the reaction mixture at the exit of this zone is from approximately 720° C. to 800° C., the pressure in the cracking tube at the exit of this zone is from 120 kPa to 240 kPa, and the weight ratio of the quantity of the hydrocarbon mixture employed to that of steam is approximately from 1 to 6.

Furthermore, the temperature of the reaction mixture travelling in the cracking tube may increase from the entry to the exit of the radiation zone of the furnace according to a profile such as that described in European Patent Applications EP-A-252,355 and EP-A-252,356.

Another subject of the present invention is an apparatus specially designed for making it possible to implement the process described above. The apparatus comprises, on the one hand, a hydrocarbon steam-cracking furnace essentially comprising a heating chamber equipped with means of heating and traversed by at least one cracking tube and, on the other hand, an infrared spectrophotometer capable of operating in at least one range of the near infrared region ranging approximately from 0.8 to 2.6 microns and intended to perform measurements of absorbance of the hydrocarbon mixture feeding the cracking tube. The means for heating the heating chamber of the cracking furnace generally consist of burners whose arrangement in the chamber and size may be chosen or whose use may be adapted at will, so that the heating power applied along the cracking tube is distributed in a more or less homogeneous manner, in particular such as described in European Patent Applications EP-A-252,355 and EP-A-252,356. The cracking tube may be arranged horizontally or vertically across the heating chamber, particularly in the radiation zone of the furnace. It may include a reaction volume which is constant or which varies between the first and second portions of the length of the cracking tube, from the entry to the exit of the radiation zone of the furnace, as described in European Patent Applications EP-A-252,355 and EP-A-252,356.

The measurements of absorbance of the mixture of hydrocarbons feeding the cracking tube are performed with the aid of the infrared spectrophotometer previously described. The latter may be of the Fourier transform infrared spectrophotometer type. Furthermore, it may be advantageously combined with a calculator intended to determine the value V of at least one of the conditions of the cracking reaction, by virtue of a calculation program containing at least one of the correlation relationships relating this condition to the variables on which it depends.

Furthermore, the steam-cracking furnace may be combined with a process computer and with control systems which make it possible to regulate these conditions automatically at the determined values V. The process computer may advantageously also comprise the calculator program enabling the value V to be calculated.

The infrared spectrophotometer may be arranged close to the duct feeding the furnace with a hydrocarbon mixture or to the storage vessel for this mixture, or at a greater or lesser distance from these. It may be equipped with means for transmitting data, such as optical fibres adapted to this particular type of analysis. In this case, these measurements are advantageously performed directly in real time, that is to say on line in the duct for feeding the furnace with a hydrocarbon mixture, or in the space for storing this mixture. It is also possible to install a system for sampling the mixture of hydrocarbons to be cracked, comprising either a manual device consisting essentially of a lock chamber equipped with stopcocks, or an automatic device governed by a programmable automaton. In this case, this system may be arranged in the duct for feeding the furnace with a mixture of hydrocarbons, or in the storage vessel for this mixture. The absorbance measurements may also be carried out in non-real time, that is to say in delayed time.

The present invention is found to be particularly useful in industrial steam-cracking plants of considerable size and production capacity. In fact, by virtue of this process, any error in space time yield due to the fluctuations in the nature and in the composition of the mixture of hydrocarbons to be cracked is markedly reduced, or even suppressed, thus avoiding the manufacture either of undesirable products or of products obtained at an unsatisfactory space time yield.

The following examples, which do not imply any limitation, illustrate the present invention.

EXAMPLE 1

Manufacture of ethylene by a steam-cracking reaction of a naphtha of variable composition with a desired ethylene yield of 22%.

A naphtha steam-cracking reaction is carried out in a furnace essentially comprising a brickwork radiation heating chamber consisting of a rectangular parallelepiped having an internal length of 9.75 m, an internal width of 1.70 m and an internal height of 4.85 m. In this heating chamber there is arranged a cracking tube made of refractory steel based on nickel and chromium having a total length of 80 m, an internal diameter of 108 mm and a thickness of 8 mm. The cracking tube is in the shape of a zigzag comprising 8 horizontal straight sections, each of equal length, connected to each other by elbows.

The radiation heating chamber of the furnace is provided with burners arranged on the walls of the chamber, in 5 horizontal rows, situated at an equal distance from each other. The heating power of all these burners is distributed homogeneously among these 5 rows.

The cracking tube is fed, on the one hand, with steam at a constant rate of 900 kg/h and, on the other hand, with a naphtha of a composition which can vary with time, at a constant rate of 2,800 kg/h. Over a period of 24 h, the composition of the naphtha employed varies so that its weight content of paraffins changes from 72% to 68%, its weight content of naphthenic compounds from 20% to 23%, its weight content of aromatic compounds from 8% to 9%, and its relative density from 0.713 to 0.719.

The pressure of the reaction mixture at the exit of the radiation zone of the furnace is approximately 165 kPa. The cracking temperature T at the exit of this zone can vary in the course of this manufacture and is determined so that the yield of ethylene is constantly equal to 22%. The cracking temperature at the entry of the radiation zone of the furnace, initially close to 550° C., is subject to slight variations with time, due to those of the exit temperature T.

Once every 15 minutes, a sample of naphtha feeding the cracking tube is analysed by means of an "Infraalyzer 500" infrared spectrophotometer, sold by Bran-Luebbe (United States of America). (Infraalyzer is a trade mark) At each analysis, a series of 5 absorbance measurements is performed according to a method combining transmission and reflection and corresponding to the Beer-Lambert absorption law, at the following 5 wavelengths, expressed in microns: 2.278, 2.308, 2.398, 2.439 and 2.475. The results of these 5 measurements are denoted $R_1$, $R_2$, $R_3$, $R_4$ and $R_5$ respectively.

The results are transmitted to a "Solar 16/65" process computer sold by Bull (France), linked directly to the infrared spectrophotometer.(Solar is a trade mark) The process computer is, in particular, equipped with a program making it possible to calculate the value of the cracking temperature T at the exit of the radiation zone of the furnace as a function of the results $R_1$, $R_2$, $R_3$, $R_4$ and $R_5$ of the 5 absorbance measurements, for the desired yield of ethylene, EY, preset at 22%, by the application of the following correlation relationship:

$$T=509+11.63EY+326R_1-448R_2+688R_3-692R_4+611R_5$$

with T expressed in degrees Celsius. When the value of the cracking temperature T has thus been determined, the process computer immediately controls the process to achieve the desired temperature at the exit of the radiation zone of the furnace.

During the 24-h period when the composition of the naphtha has varied as shown above, it is observed that the cracking temperature T has itself varied within a range from 788° C. to 806° C. During this same period it is found that the ethylene output has remained constant at 616 kg/h and that, consequently, the yield of ethylene has been maintained at 22%, despite the variations in the composition of the naphtha.

EXAMPLE 2

Manufacture of ethylene and of propylene by a steam-cracking reaction of a naphtha of variable composition, with a desired ratio of the yield of propylene to that of ethylene of 0.6.

The cracking reaction is carried out in a furnace identical with that described in Example 1.

The cracking tube is fed, on the one hand, with steam at a constant rate of 964 kg/h and, on the other hand, with a naphtha of a composition which can vary with time, at a constant rate of 3,000 kg/h. Over a 24-h period, the composition of the naphtha employed varies so that its weight content of paraffins changes from 68% to 76%, its weight content of naphthenic compounds changes from 23% to 19%, its weight content of aromatic compounds changes from 9% to 5% and its relative density from 0.719 to 0.697.

The pressure of the reaction mixture at the exit of the radiation zone of the furnace is approximately 165 kPa.

The cracking temperature T at the exit of this zone can vary in the course of this manufacture and is determined so that the ratio between the yield of propylene and that of ethylene is constantly equal to 0.6. The cracking temperature at the entry of the radiation zone of the furnace, initially close to 550° C., is subjected to slight variations in the course of time, due to those of the exit temperature T.

Once every 15 minutes, a sample of the naphtha feeding the cracking tube is analysed by means of an "Infralyzer 500" infrared spectrophotometer, sold by Bran-Luebbe (United States of America). At each analysis, a series of 5 absorbance measurements is performed according to a method combining transmission and reflection and corresponding to the Beer-Lambert absorption law, at the following 5 wavelengths, expressed in microns: 2.278, 2.308, 2.398, 2.439 and 2.475. The results of these 5 measurements are denoted $M_1$, $M_2$, $M_3$, $M_4$ and $M_5$ respectively.

These results are transmitted to a "Solar 16/65" process computer sold by Bull (France), linked directly to the infrared spectrophotometer. The process computer is, in particular, equipped with a program which makes it possible to calculate the value of the cracking temperature T at the exit of the radiation zone of the furnace as a function of the results $M_1$, $M_2$, $M_3$, $M_4$ and $M_5$ of the 5 absorbance measurements, and of the desired ratio (PY/EY) between the yield of propylene and that of ethylene, preset at 0.6, by application of the following correlation relationship:

$$T=994-357PY/EY+161M_1-222M_2+341M_3-342M_4+303M_5$$

with T expressed in degrees Celsius.

When the value of the cracking temperature T has thus been determined, the process computer immediately controls the crackin temperature at the exit of the radiation zone of the furnace at this value.

During the 24-h period where the composition of the naphtha has varied as indicated above, it is observed that the cracking temperature T has itself varied in a range from 800° C. to 785° C. During this same period, it is found that the ratio between the yield of propylene and that of ethylene has remained constant at 0.6, despite the variations in the composition of the naphtha.

EXAMPLE 3

Manufacture of ethylene at a constant rate of 0.640 t/h and of propylene at a constant rate of 0.370 t/h by a steam-cracking reaction of a naphtha of variable composition.

The cracking reaction is performed in a furnace identical with that described in Example 1. The cracking tube is fed with steam and with naphtha of a composition which can vary with time. Over a period of 24 hours the composition of the naphtha employed varies so that its weight content of paraffins changes from 76% to 72%, its weight content of naphthenic compounds from 19% to 20%, its weight content of aromatic compounds from 5% to 8% and its relative density from 0.697 to 0.713.

The pressure of the reaction mixture at the exit of the radiation zone of the furnace is approximately 165 kPa. The cracking temperature T at the exit of the radiation zone of the furnace and the naphtha feed flow rate Q to the tube can vary during this manufacture and are determined so that the output rates of ethylene and of propylene are constantly equal to 0.640 t/h and 0.370 t/h respectively. The cracking temperature at the entry of the radiation zone of the furnace, initially close to 550° C., is subject to slight variations with time, due to those of the exit temperature T. The steam feed rate varies with time so that the weight ratio of the quantity of hydrocarbon mixture employed to that of steam is constant at 3.

Once every 10 minutes a sample of the naphtha feeding the cracking tube is analysed by means of an "Infralyzer 500" infrared spectrophotometer sold by Bran-Luebbe (United States of America). At each analysis, a series of 5 absorbance measurements is performed according to a method combining transmission and reflection and corresponding to the Beer-Lambert absorption law, at the following 5 wavelengths, expressed in microns: 2.278, 2.308, 2.398, 2.439 and 2.475. The results of these 5 measurements are denoted $L_1$, $L_{2l}$, $L_3$, $L_4$ and $L_5$ respectively.

The results are transmitted to a "Solar 16.65" process computer sold by Bull (France), linked directly to the infrared spectrophotometer. The process computer is, in particular, equipped with a program which makes it possible to calculate the value S of the naphtha feed rate Q to the cracking tube, and of the cracking temperature T at the exit of the radiation zone of the furnace as a function of the results $L_1$, $L_2$, $L_3$. $L_4$ and $L_5$, of the output rate of ethylene $Q_E$ set at 0.640 t/h and of the output rate of propylene $Q_p$ set at 0.370 t/h by the application of the following two correlation relationships:

$$100Q_E=Q(-36.4+0.086T-2.65Q-28L_1+38.5L_2-59.2L_3+59.5L_4-52.56L_5)$$

$$Q_p=Q_E(2.552-0.0028T+0.0775Q+0.451L_1 0.6206-L_2+0.954L_3-0.958L_4+0.847L_5)$$

with T expressed in degrees Celsius and the flow rates Q, $Q_E$ and $Q_p$ in tonnes/hour.

When the values of the cracking temperature T and the naphtha feed rate Q to the cracking tube have thus been determined, the process computer immediately controls the cracking temperature at the exit of the radiation zone of the furnace and the naphtha feed rate to the cracking tube at these values.

During the 24-hour period during which the composition of the naphtha has varied as shown above, it is observed tha the cracking temperature T has itself varied within a range from 789° C. to 795° C., while the naphtha feed rate Q to the cracking tube has varied within a range from 2.8 t/h to 2.9 t/h. During this same period, it is found that the output rate of ethylene has remained constant at 0.640 t/h and the output rate of propylene has remained constant at 0.370 t/h, despite the variations in the naphtha composition.

We claim:

1. A process for steam cracking a mixture of hydrocarbons comprising passing steam and the mixture of hydrocarbons through at least one heated cracking tube maintained at cracking reaction conditions wherein the process is controlled by (a) using a spectrophotometer to measure n absorbances of the mixture of hydrocarbons fed to the cracking tube, wherein n is at least two, wherein each absorbance is measured at a wavelength in the range from 0.8 to 2.6 microns, (b) choosing at least one condition of the cracking reaction, and using the n absorbance measurements $R_i$ to determine at least one value V of the at least one of the conditions of the cracking reaction said value V being determined through a correlation relationship, said correlation relationship connecting the n absorbance measurements Ri with a desired space time yield P of one or more products of the cracking reaction and with the value V and (c) controlling the process to operate at the determined value (s) V in order to obtain the desired space time yield P.

2. The process according to claim 1 wherein the at least one of the conditions of the cracking reaction is chosen from the flow rates of steam and of the hydrocarbon mixture feeding the cracking tube, the cracking temperature or the cracking pressure at any point in this tube, and the weight ratio of the quantity of the hydrocarbon mixture employed to that of the steam.

3. The process according to claim 1 wherein the space time yield of the one or more reaction products is defined by a yield, by a flow rate or by a ratio between two quantities of products or of groups of products manufactured.

4. The process according to claim 1 wherein the number of n absorbance measurements is from 2 to 20.

5. The process according to claim 1 wherein at least one of the n wavelengths at which the absorbance measurements are performed expressed in microns, is chosen from the group consisting of about 2.141, 2.166, 2.181, 2.278, 2.308, 2.347, 2.375, 2.398, 2.439, 2.457 and 2.475.

6. The process according to claim 1, wherein the n wavelengths were selected during a calibration procedure by statistical methods utilizing factor analysis and multi-linear regressions.

7. A process for steam cracking a mixture of hydrocarbons, in order to control at least one space time yield of one or more products of the steam cracking reaction at a desired value P, the process comprising:

(a) feeding steam and the mixture of hydrocarbons through at least one heated cracking tube maintained at cracking conditions, (b) measuring by means of a spectrophotometer n absorbances of the mixture of hydrocarbons at n wavelengths chosen in the near infrared region of the spectrum from 0.8 to 2.6 microns, n being at least 2, (c) choosing at least one condition of the cracking reaction and determining a value V of the at least one condition of the steam cracking reaction directly from the n absorbance measurements, Ri, by means of a correlation relationship, said correlation relationship connecting the n absorbance measurements, Ri, with the at least one desired space time yield P and with the at least one condition V, (d) measuring the at least one condition, and (e) adjusting the at least one condition to the determined value V in order to obtain the desired value P of the at least one space time yield.

8. The process according to claim 1, wherein the mixture of hydrocarbons is a mixture of liquid hydrocarbons.

9. The process according to claim 1 wherein the mixture of hydrocarbons is a mixture of gaseous hydrocarbons.

10. The process according to claim 1, wherein the mixture of hydrocarbons is selected from the group consisting of naphtha, light gasoline and gas oil.

11. A process according to claim 1 wherein the correlation relationship is linear or algebraic.

12. A process according to claim 1 wherein the wavelengths selected are those the absorbance of which changes most during calibration procedure.

13. A process according to claim 1 wherein there is continual measurement of the at least two absorbances of the mixtures of hydrocarbons.

14. A process according to claim 1 wherein the spectrophotometer is an infrared spectrophotometer.

15. The process according to claim 2, wherein the space time yield of the one or more reaction products is defined by a yield, by a flow rate or by a ratio between two quantities of products or of groups of products manufactured.

16. The process according to claim 7 wherein the at least one condition of the steam cracking reaction is chosen from the flow rates of steam and of the hydrocarbon mixture feeding the cracking tube, the cracking temperature or the cracking pressure at any point in this tube, and the weight ratio of the quantity of the hydrocarbon mixture employed to that of the steam, and wherein the space time yield of the one or more reaction products is defined by a yield, by a flow rate or by a ratio between two quantities of products or of groups of products manufactured.

* * * * *

UNITED STATES PATENT AND TRADEMARK OFFICE

CERTIFICATE OF CORRECTION

PATENT NO. :5,082,985

DATED :January 21, 1992

INVENTOR(S) :Pierre J. Crouzet et al.

It is certified that error appears in the above-identified patent and that said Letters Patent is hereby corrected as shown below:

Title page, column 1, Item [73] Assignee, please insert:

"Naphtachimie S.A.,
Courgeuoie, France and

BPChemicals Limited
London, England".

Signed and Sealed this

Eighth Day of June, 1993

*Attest:*

*Attesting Officer*

Michael K. Kirk

MICHAEL K. KIRK

*Acting Commissioner of Patents and Trademarks*

UNITED STATES PATENT AND TRADEMARK OFFICE

CERTIFICATE OF CORRECTION

PATENT NO. : 5,082,985

DATED : January 21, 1992

INVENTOR(S) : Pierre J. Crouzet, et al

It is certified that error appears in the above-indentified patent and that said Letters Patent is hereby corrected as shown below:

On the title page item [73], should read —Naphtachimie S. A., Courbeuoie, France and BP Chemicals Limited London, England—.

This Certificate Supersedes Certificate of Correction issued June 8, 1993

Signed and Sealed this

Twentieth Day of December, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,082,985

DATED : January 21, 1992

INVENTOR(S) : Pierre J. Crouzet et al.

It is certified that error appears in the above-indentified patent and that said Letters Patent is hereby corrected as shown below:

On the Certificate of Correction of December 20, 1994, please change "Courgeuoie" to -- Courbevoie--.

This certificate supersedes Certificate of Correction issued December 20, 1994.

Signed and Sealed this

Eighteenth Day of April, 1995

Bruce Lehman

*Attest:*

BRUCE LEHMAN

*Commissioner of Patents and Trademarks*

*Attesting Officer*